US007325551B2

(12) United States Patent
Henninger et al.

(10) Patent No.: US 7,325,551 B2
(45) Date of Patent: Feb. 5, 2008

(54) HAIR-SHAPING APPLIANCE

(75) Inventors: Friedrich Henninger, Kelkheim (DE); Robert Jung, Friedburg (DE); Dieter Liebenthal, Maintal (DE); Wilfried Rolf, Rinkel-Eschenau (DE)

(73) Assignee: Braun GmbH, Kronberg ( * ) Notice: Subject to any disclaimer, the term of this patent is extended or adjusted under 35 U.S.C. 154(b) by 390 days.

(21) Appl. No.: 10/834,598

(22) Filed: Apr. 28, 2004

(65) Prior Publication Data

US 2004/0244810 A1 Dec. 9, 2004

Related U.S. Application Data

(63) Continuation of application No. PCT/EP03/07977, filed on Jul. 22, 2003.

(30) Foreign Application Priority Data

Aug. 29, 2002 (DE) ..... 102 39 713

(51) Int. Cl.
*A45D 6/06* (2006.01)

(52) U.S. Cl. ..... 132/228

(58) Field of Classification Search ..... 132/225, 132/224, 227, 228, 232, 272
See application file for complete search history.

(56) References Cited

U.S. PATENT DOCUMENTS 3,835,292 A * 9/1974 Walter et al. ..... 219/222
3,921,648 A 11/1975 Barradas
3,937,232 A * 2/1976 Tomaro ..... 132/232
4,209,685 A 6/1980 Walter et al.
6,029,677 A 2/2000 Nanba et al.
6,701,937 B2 * 3/2004 Janouch et al. ..... 132/228
2003/0037796 A1 2/2003 Janouch et al.

FOREIGN PATENT DOCUMENTS

DE 298 22 238 U1 5/2000
DE 100 12 193 A1 9/2001
WO WO 95/13723 5/1995
WO WO 2004/019723 3/2004

* cited by examiner

*Primary Examiner*—Robyn Doan
(74) *Attorney, Agent, or Firm*—Fish & Richardson P.C.

(57) ABSTRACT

A hair-shaping appliance includes a hand-held portion, a hair-shaping element extending from the hand-held portion, an evaporator mounted within the shaping element, a tank mounted within the hair-shaping element in a moveable manner, a dosing device connected to the tank, and an actuating button connected to the tank. The actuating button and tank are connected such that movement of the actuating button displaces the tank along a longitudinal direction of the appliance (e.g., towards and away from the evaporator). In addition, the actuating button is positioned on the hand-held portion of the appliance and is positioned to allow single-handed operation.

42 Claims, 5 Drawing Sheets

HAIR-SHAPING APPLIANCE

RELATED APPLICATIONS

This application is a continuation of PCT application number PCT/EP03/07977, filed on Jul. 22, 2003, and claims priority from German application Ser. No. 102 39 713.9, filed Aug. 29, 2002. Both priority documents are incorporated herein by reference.

TECHNICAL FIELD

This invention relates to hair-shaping appliances. More particularly, the invention relates to hair-shaping appliances that include an evaporator for generating steam.

BACKGROUND

Known hair-shaping appliances are usually equipped with an evaporator and are commonly referred to as steam-styling tongs or steam curling tongs. For example, German patents DE 100 12 194 A1 and DE 100 12 193 A1 each disclose steam styling tongs which, on that side of the shaping element which is located opposite the hand-held part, have a water tank from which water, metered via a dosing device, can be moved into or onto the evaporator, with the result that a surge or jet or steam passes out through the shaping element onto the hair wound around it. These dosing devices comprise a wick which passes out of the tank and, by virtue of the tank being pushed into the shaping element, can be moved in the direction of an evaporated surface and discharges droplets of water onto the latter.

Although these known steam styling tongs have proven widely successful, they are capable of improvement in a number of respects. First, the operation of the steam function is not yet satisfactory, in so far as the water tank has to be pushed into the shaping element, for metering purposes, by one hand, while the other hand holds the styling tongs firmly. This is often impractical if the steam styling tongs are being used, for example, at the back of the head. Also, the metering accuracy of the previously known dosing device is capable of improvement. The tank is intended to be pushed in via a deformable diaphragm, with the result that water pushes through the wick and is passed to the evaporator in the form of droplets. Since this is often more liquid than is to be evaporated, it is necessary to provide special means for feeding excess liquid back into the tank from the evaporator chamber.

SUMMARY

The object of the present invention is to provide an improved hair-shaping appliance of the above-mentioned type which avoids disadvantages of the prior art and advantageously develops this prior art. It is preferably intended to improve the handling of the steam function and of the associated evaporation-liquid tank.

An aspect of the invention features, a hair-shaping appliance having a hand-held part, a shaping element, which is connected to the hand-held part, an evaporator, a tank, from which the evaporator can be supplied with evaporation liquid, and a dosing device, by means of which it is possible to control the quantity of evaporation liquid passing into the evaporator, the tank being mounted in a movable manner, such that it can be displaced axially in the longitudinal direction of the appliance, and it being possible for the dosing device to be actuated by movement of the tank.

In one aspect, the invention features a hair-shaping apparatus (e.g., an appliance) including a hand-held portion, a hair-shaping element extending from the hand-held portion, an evaporation mounted within the shaping element, a tank mounted within the hair-shaping element in a moveable manner, a dosing device connected to the tank, and an actuating button connected to the tank. The actuating button is positioned on the hand-held portion and movement of the actuating button displaces the tank along a longitudinal direction of the apparatus.

In another aspect, the invention features a hair-shaping apparatus including a hand-held portion including an actuating button, a shaping element extending from the hand-held portion, an evaporator mounted within the shaping element, a tank from which the evaporator can be supplied with liquid and being insertable into the shaping element, and a dosing device for controlling the quantity of liquid passing from the tank to the evaporator. The dosing element is connected to the actuating button when the tank is inserted into the shaping element.

The hair-shaping apparatus thus provides, on the hand-held part, an actuating button which is connected to the dosing device and allows the dosing device to be actuated by the hand which is gripping the hand-held part. Single-handed operation of the apparatus (e.g., the appliance) including the discharge of steam, is possible, which makes the appliance considerably easier to handle, th particular at the back of the head. Using the actuation button arranged on the hand-held part, it is easily possible to control when and how much evaporation liquid passes into the evaporator. It is also possible to control when and how much steam is discharged at the shaping element.

In some embodiments, the tank of the hair-shaping apparatus is mounted in a movable manner, and the dosing device is actuated by a corresponding movement of the tank. The tank is preferably mounted such that it can be displaced axially in the longitudinal direction of the appliance. If the tank is moved into a first end position, liquid can pass out of the tank into the evaporator and evaporate there. If the tank is moved into a second end position, the supply of liquid into the evaporator is interrupted.

In embodiments, the tank is advantageously arranged at that end section of the shaping element which is located opposite from the hand-held part. This makes it possible to achieve a compact construction for the appliance. In order, nevertheless, to achieve convenient actuation and/or operation of the tank, the tank is connected to the actuating button, which is provided on the hand-held part, via a connecting component, with the result that it is possible to displace the tank via the actuating button and thus to control the supply of liquid into the evaporator.

In some embodiments, the connecting component, in addition to connecting the tank and the actuating button, advantageously forms a heat guard, which covers the heatable shaping element. The connecting component or the heat guard may be formed in different ways. According to an advantageous embodiment of the invention, the connecting component extends in the form of a half-shell around and along the shaping element, essentially over the entire length of the latter.

In some embodiments, a particularly easy-to-assemble design is achieved in that the tank, the connecting component and the actuating button are formed integrally with one another, and are preferably injection molded from plastic.

In embodiments, the actuating button for actuating the dosing device and/or for displacing the tank may be arranged at various locations of the hand-held part. In accordance with a particularly advantageous arrangement, the actuating button is located at the shaping-element end of the hand-held part or at the point of transition between the hand-held part and the shaping element, in the region of a thumb or forefinger of the hand which is gripping the hand-held part. If the hair-shaping appliance has a clamping mouth which can be pivoted open and closed, and by means of which hair can be pressed against the shaping element, the actuating button for the steam function is preferably located on a side of the appliance which is located opposite an actuating button for the clamping mouth.

In some embodiments, the tank, which is arranged at the end of the shaping element can be directly gripped and displaced in order to bring about the supply of liquid into the evaporator. The tank here is thus assigned two actuating sessions, which optionally single-handed or two-handed operation of the appliance is possible.

It is possible to control the supply of liquid into the evaporator by displacement of the tank in that the dosing device has a wick which passes through a tank wall located opposite the evaporator and which can be moved in the direction of an evaporator surface, and away from the latter, by movement of the tank. If the wick is moved onto the evaporator surface, this results in evaporation of liquid from the wick. In contrast, if the wick is moved away from the evaporator surface, the generation of steam is interrupted. In a development of the invention, the tank can be moved in the direction of the evaporator to such an extent that the projecting wick engages with the evaporator surface, that is to say rests directly thereon. The adjustment path of the tank, however, is preferably limited, with the result that the wick cannot be pressed to an excessive extent against the evaporator surface.

In some embodiments, the wick is divided at its end which is directed towards the evaporator surface into a plurality of end sections. As a result, the wick can sufficiently transport a large quantity of liquid. In certain embodiments, the wick preferably has an approximately V-shaped fanned-out portion, and the evaporator surface has a V-shaped contour which complements the same, with the result that the wick can be moved onto the evaporator surface by way of the V-shaped fanned-out portion.

The capillary-forming wick can be arranged and/or oriented in different ways in respect of the tank itself. In some embodiments, the wick extends eccentrically into the tank. i.e. it is laterally offset in the radial direction toward a tank wall. This makes it easier, in the case of only low filling levels in the tank, for residues of liquid in the tank also to be taken up.

In some embodiments, the tank can be plugged in a releasable manner into the headpiece of a heating-tube covering, which encloses the evaporator and/or bounds an evaporator chamber, the tank preferably being secured by an elastic latching-action securing means.

The tank wall may have a preferably integrally formed wick guide which can be plugged axially into an evaporator-chamber wall, the latching-action securing means preferably being provided between the evaporator-chamber wall and the tank and preventing the tank from slipping out in an undesirable manner, while nevertheless allowing the tank to move axially. The latching-action securing means may be provided by means of a securing spring which is fixed to the appliance and can be snap-fitted over a protrusion on the tank. In particular, it is possible to provide a U-shaped spring clip which can expand radially and, when the wick guide is pushed in, can slide over a radial protrusion provided on the latter and/or can snap into a radial undercut on the wick guide.

In some embodiments, in order to prevent steam from passing out of the evaporator chamber in an undesirable direction, the hair-shaping apparatus features a radial seal between the wick guide and the cutout in the evaporator-chamber wall into which the wick guide is plugged. The radial seal is preferably designed such that it allows axial displaceability of the wick guide and provides sealing in a number of axial positions of the tank. An advantageous configuration of the invention provides a lip seal, preferably with a double lip.

In order to simplify operation and prevent steam from being generated unintentionally, it is possible for the tank to be prestressed by means of a spring device into its position in which the supply of liquid is prevented (e.g., the tank is biased in a position in which liquid transport to the evaporator is prevented). In some embodiments, a spring-loaded pressure element is provided on the headpiece of the heating-tube covering, in which the tank is seated by way of its wick guide, and this pressure element pushes against the tank base. The movement capability of the pressure element is preferably limited by means of stops. The end positions of the spring-loaded pressure element define the two operating positions of the tank, namely the position in which the supply of liquid is prevented (e.g., the dosing device does not contact the evaporator) and the position in which it is possible for liquid to be supplied (e.g., the dosing device is in contact with the evaporator).

In order to achieve a uniform supply of liquid even without the tank being pushed in, some embodiments of the hair-shaping appliance features a venting valve for the tank, by means of which, when liquid passes out of the tank, a corresponding quantity of air can be guided back into the tank. The venting valve may be provided at various locations on the tank. According to a preferred configuration of the invention, it is possible for the venting valve to be installed directly alongside the wick guide, in the adjacent tank-base section.

In order to improve the operation of filling the tank, the tank has a cover, which is covered by a section of the appliance when the tank is installed and can only be accessed and/or opened when the tank has been removed. This prevents the situation where the entire hair-shaping appliance is held beneath a water faucet in order for the tank to be filled. In order for it to be possible to open the cover, the tank has to be removed from the rest of the appliance beforehand. It is possible to provide a pivoting lid and/or a stopper as the cover, thus allowing easy opening of the tank. In contrast to the prior art, it is not necessary for the entire dosing-device subassembly to be unscrewed from the tank in order for it to be possible for the latter to be filled. The cover expediently closes the tank in a liquid-tight manner.

In some embodiments, the cover of the tank may be provided on a tank-cover section which, when the tank is installed, is located beneath the clamping mouth, which interacts with the shaping element.

In certain embodiments, it is possible for at least a portion of the tank to have an approximately half-moon-shaped cross section with a flat side, on which the tank cover is provided. In some embodiments, the tank is located in that half of the shaping element of the appliance which is located opposite the clamping mouth of the appliance, preferably with the flat side beneath the clamping mouth. In the case of the abovementioned half-moon-shaped cross-sectional configuration of the tank, the radially offset wick may be arranged in the direction of the flat side.

The details of one or more embodiments of the invention are set forth in the accompanying drawings.

DESCRIPTION OF DRAWINGS

Like reference symbols in the various drawings indicate like elements.

DETAILED DESCRIPTION

The hair-shaping appliance shown in the figures is a so-called straightening appliance by means of which curly or frizzy hair can be smoothed out, but also shaped in any other desired way. The appliance is designed as gas-operated steam styling tongs in which an evaporator is heated, and generates steam, by means of a gas burner.

Figure 1:
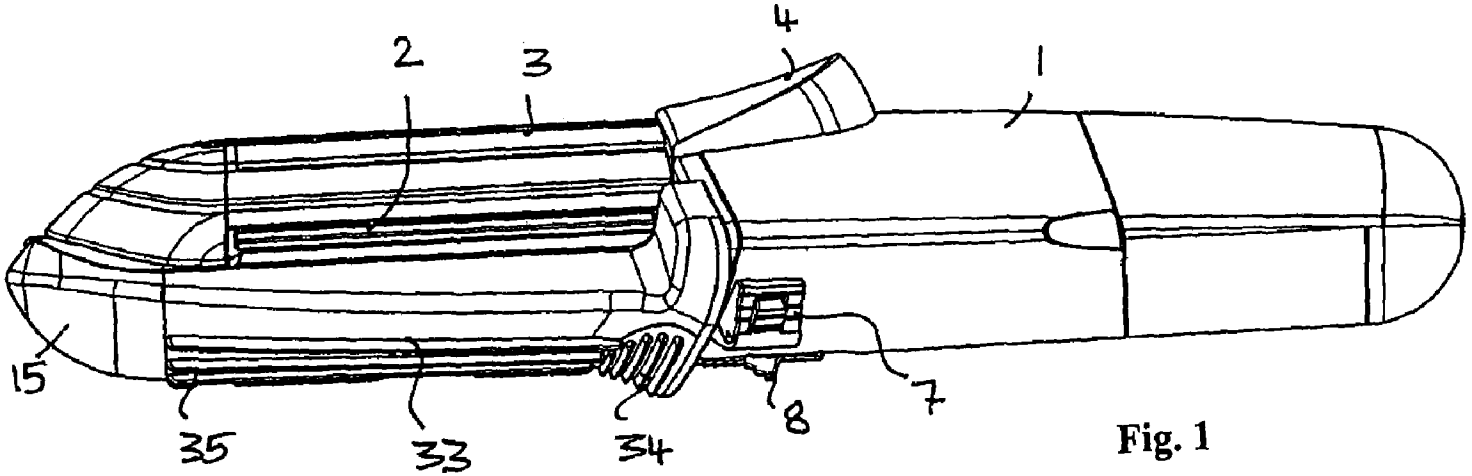
FIG. 1 shows a side view of a hair-shaping appliance.
Figure 2:
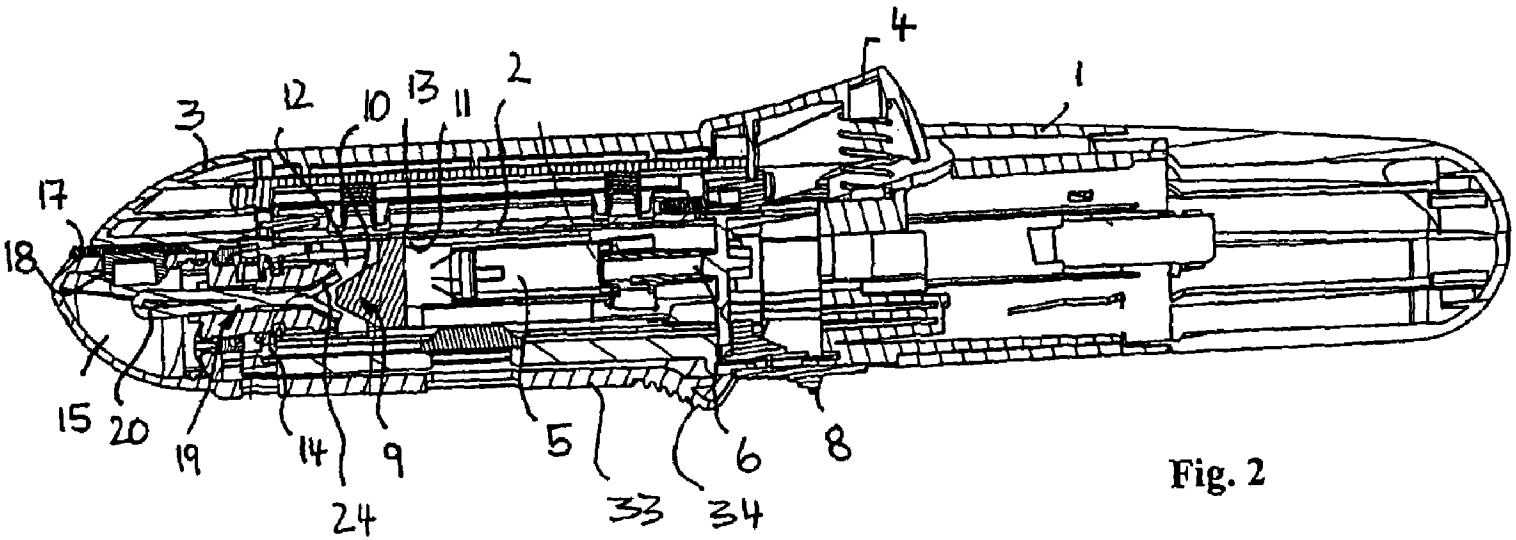
FIG. 2 shows a longitudinal section through the hair-shaping appliance from FIG. 1.

Referring to FIGS. 1 and 2, the appliance has an essentially cylindrical hand-held part 1, by which the appliance can be gripped. A shaping element 2, by means of which the hair can be shaped and styled, is attached to the end side of the hand-held part 1. A clamping mouth 3 is located in the form of a half-shell on a lateral-surface side of the heated shaping element 2 and can be pivoted away from the shaping element 2 by means of a rocker button 4.

Arranged in the interior of the shaping element 2, as a heating device for heating the shaping element 2, is a burner 5, by means of which a suitable combustible gas can be burnt using a catalyst. The burner 5 is fed via a gas supply 6 from a gas cartridge, which may be accommodated in the interior of the hand-held part 1. The gas supply 6 can be controlled via a switch 7 on the outside of the hand-held part 1. An ignition device assigned to the burner 5 may be actuated by an ignition switch 8, which is likewise provided on the hand-held part 1.

Referring particularly to FIG. 2, an evaporator 9 is arranged at the end of the burner 5. An evaporator plate 10 closes the burner tube 11 of the burner 5 on the end side and separates the combustion space from an evaporator chamber 12. The evaporator chamber 12 is bounded by a burner-tube covering 13, which is of tubular design and is seated over the burner tube 11, and by a headpiece 14, which closes the burner-tube covering 13 on the end side (see FIG. 6), and by the above-mentioned evaporator plate 10.

Figure 4:
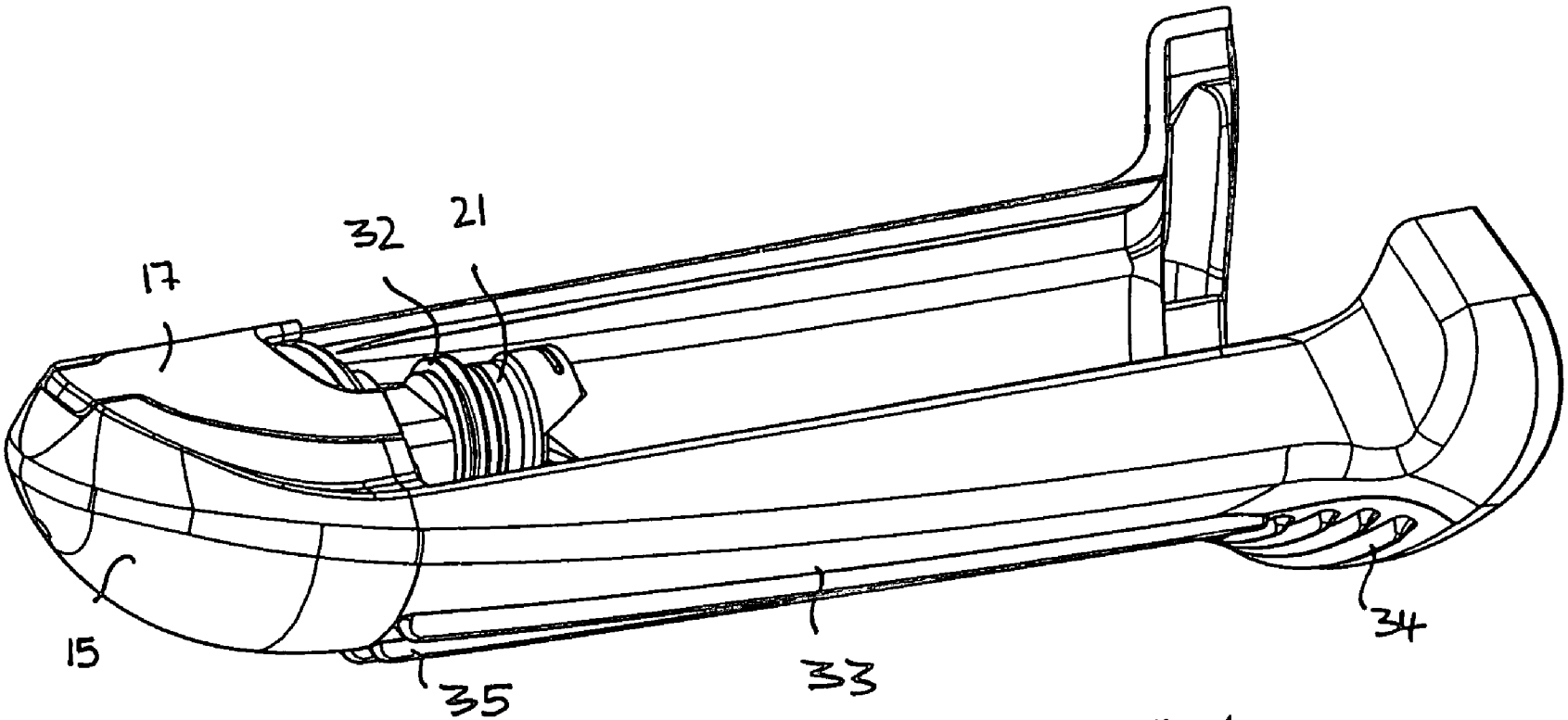
FIG. 4 shows a perspective view of the water tank from FIG. 3 in a position in which it has been removed altogether from the appliance.

Provided at an end of the appliance which is directed away from the hand-held part 1 is a tank 15, from which the evaporator 9 is supplied with water for the generation of steam. The tank 15 is shaped such that it essentially continues the contour of the rest of the appliance body. As FIGS. 1, 2 and 4 show, the tank 15 forms the tip of the shaping element 2 and has an essentially half-moon-shaped cross section, the surface area of which decreases in the direction of the tip. By way of a flat side the half-moon-shaped cross section, which extends approximately parallel to the longitudinal axis of the appliance, the tank 15 is located beneath the free end of the clamping mouth 3 when the latter is provided onto the shaping element 2. The clamping mouth 3 here covers the above-mentioned flat side 16 of the tank 15.

Figure 3:
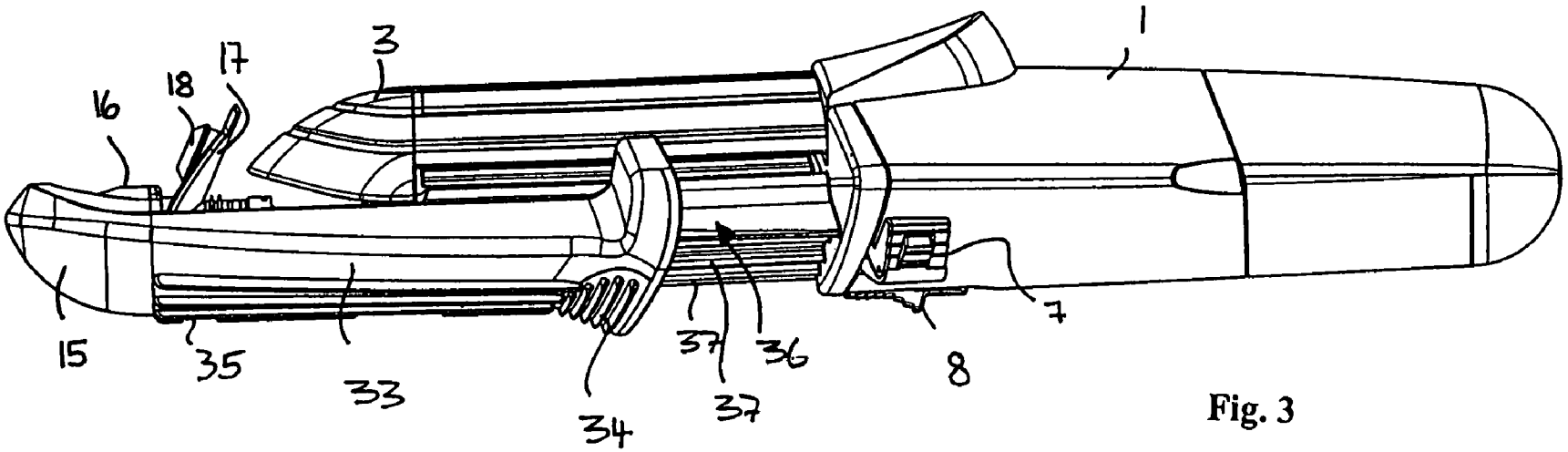
FIG. 3 shows a side view of the hair-shaping appliance from FIG. 1. The hair-shaping appliance includes a water tank, from which an evaporator of the appliance is fed, having been drawn halfway off from the rest of the appliance.

The tank 15 is plugged axially, in the longitudinal direction of the appliance, into the headpiece 14 of the burner-tube covering 13, and can be removed axially from the appliance in order for the tank to be filled. A tank cover 17 is arranged on the flat side 16 of the tank, this flat side being covered by the clamping mouth 3 when the tank is installed, with the result that the tank cover is accessible merely when the tank 15 has been removed from the rest of the steam styling tongs. As FIG. 3 shows, the tank cover 17 can only be pivoted open when the tank 15 has been pushed off in the forward direction. The tank cover 17 is preferably a flap which, in the closed state, rests flush on the flat side 16 and, by means of a seal in the form of a plug 18, closes the tank opening, located beneath the tank cover 17, in a fluid-tight manner. The arrangement and design of the tank cover 17 can provide a double safeguard to the appliance. On the one hand, the appliance is safeguarded against being held in its entirety beneath a water faucet in order for the tank to be filled, since the tank cover can only be opened when the tank 15 has been removed from the appliance. On the other hand, arranging the tank cover 17 beneath a covering which is formed by the clamping mouth 3 prevents the tank cover 17 from opening in an undesirable manner during operation.

Figure 5:
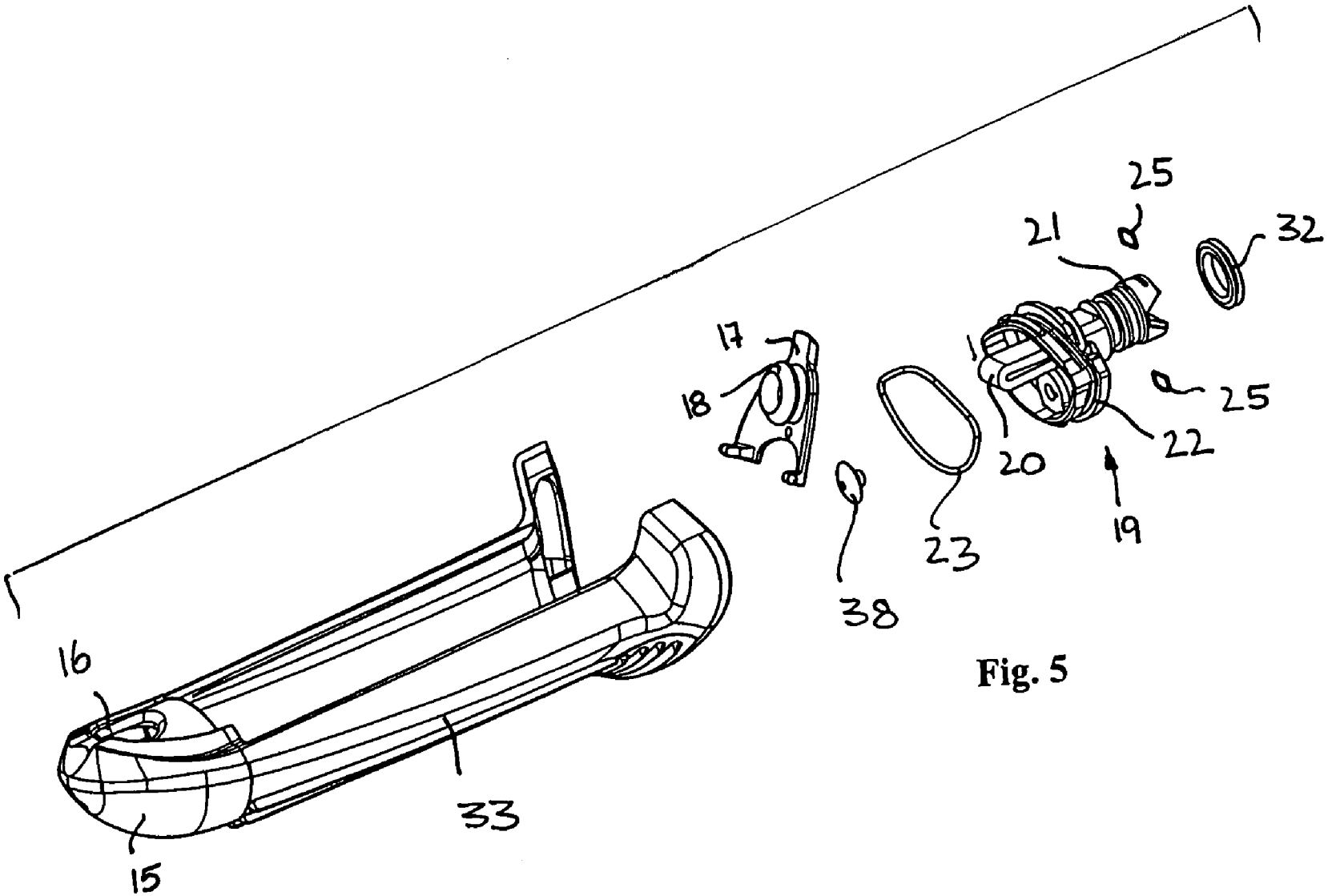
FIG. 5 shows an exploded illustration, in perspective, of the water tank and of the dosing device fastened thereon and of the cover of the water tank.

As FIGS. 2 and 5 shows, a dosing device 19 is provided between the tank 15 and the evaporator 9, this dosing device allowing liquid to be discharged in a metered manner from the tank to the evaporator. The dosing device 19 comprises a wick 20 in the form of a soldered felt sheet which is accommodated in a precisely fitting manner in an axially extending wick guide 21. As FIG. 5 shows, the wick 20 is seated in a tank base 22, by means of which the body of the tank 15 can be closed on the evaporator side. The tank base 22 is designed as a separate part and can be plugged in a precisely fitting manner into a corresponding cutout in the tank 15. An O-ring 23 functioning as a seal between the tank base 22 and the rest of the body of the tank 15 can be provided as shown in FIG. 5. As FIG. 2 shows, the tank base 22 extends radially in relation to the longitudinal axis of the appliance, while the wick guide 21 formed on the tank base 22 extends axially. The wick 20 projects into the interior of the tank 15, it being arranged in the direction of the flat side 16 of the tank and extending approximately coaxially with the burner 5. That end of the wick 20 which projects out of the tank has a V-shaped fanned-out portion 24. The ends of the felt sheet, which functions as the wick, are fixed, in the region of the fanned-out portion 24, by staples 25 on inner circumferential surfaces of the wick guide 21 (see FIGS. 2 and 5).The tank is vented via a venting valve 38 in the tank base 22.

Figure 6:
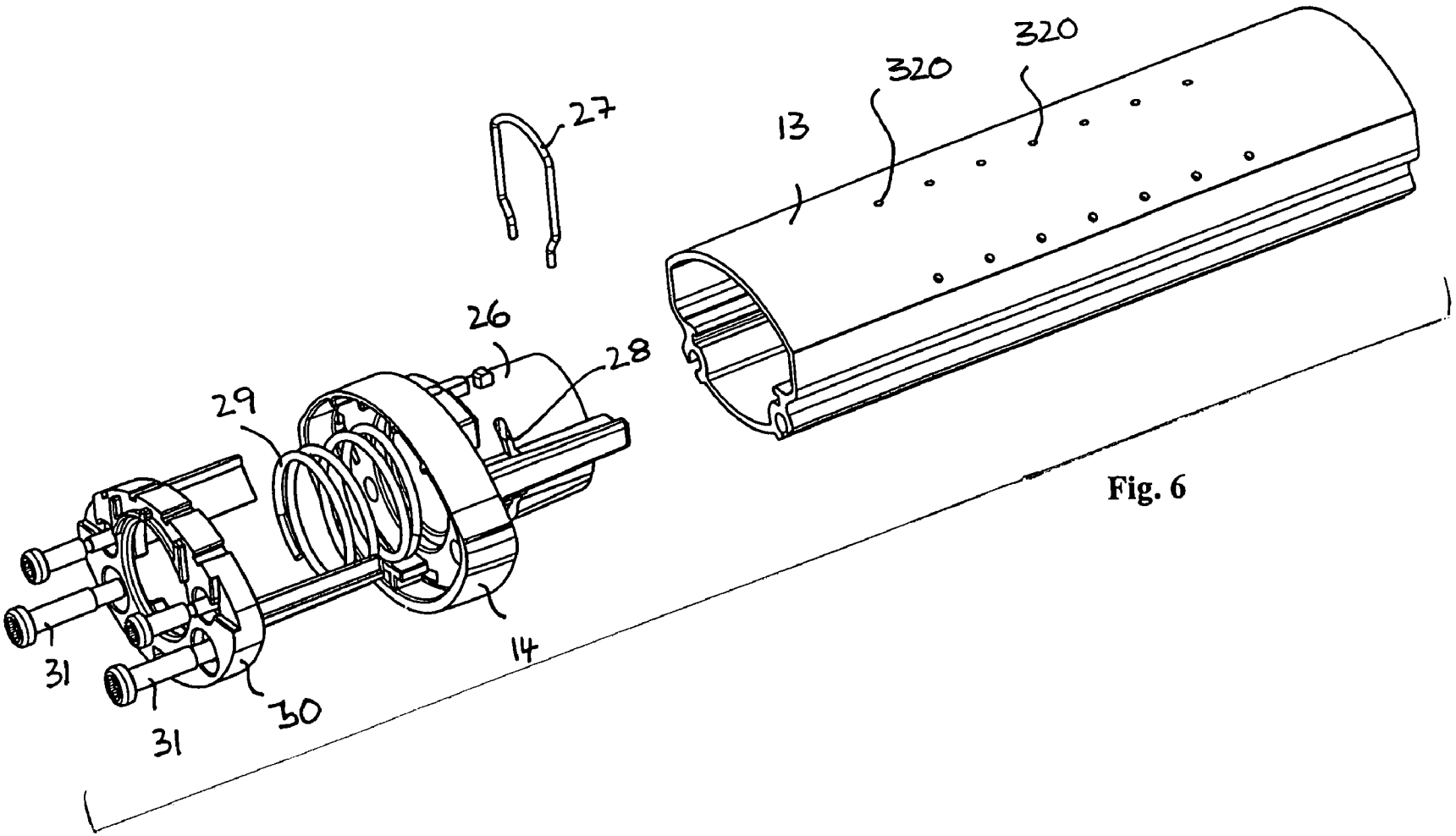
FIG. 6 shows an exploded illustration, in perspective, of the headpiece, of a heating-tube covering, into which the dosing device from FIG. 5 can be plugged.

By way of the wick guide 21 projecting from the tank 15, the tank 15 can be plugged into the headpiece 14 of the burner-tube covering 13, with the result that the wick 20 projects into the interior of the evaporator chamber 12. As FIG. 6 shows, the headpiece 14 has a cylindrical extension 26, which forms an inner clearance in which the approximately cylindrical wick guide 21 can be plugged. The headpiece 14 is seated firmly on the burner-tube covering 13. The tank 15, however, is seated in an axially displaceable manner, by way of the wick guide 21, in the headpiece 14. As FIG. 6 illustrates, the tank base 22, or its wick guide 21, is secured in the headpiece 14 via a snap-in spring 27. The U-shaped snap-in spring 27 is seated on the extension 26 in tangential cutouts 28, with the result that the legs of the snap-in spring 27 project into the inside of the clearance formed within the extension 26. As shown, the snap-in spring 27 is secured axially on the extension 26. However, in some embodiments, the legs of the snap-in spring 27 can expand radially. If the tank 15 is pushed into the headpiece 14 by way of the wick guide 21, the legs of the snap-in spring 27 slide over a radial protrusion on the outer circumference of the wick guide 21. If the wick guide 21 has been pushed in far enough, the snap-in spring 27 snaps back again and secures the tank 15 against being drawn out of the appliance unintentionally. Despite the latching-action securing means, it is possible for the tank to be displaced axially for the purpose of supplying water into the evaporator.

A prestressing device in the form of a spring 29 is provided between the headpiece 14 of the burner-tube covering 13 and the tank 15. A pressure plate 30 is guided on the headpiece 14 such that it can be displaced axially via four bolts 31, the displaceability of the pressure plate 30 being limited via stops which are formed, on the on hand, by the heads of the bolts 31 and, on the other hand, by the end side of the headpiece 14. The spring 29 is fitted between the pressure plate 13 and the headpiece 14 and forces the pressure plate 30 to the left in FIG. 6, toward the heads of the bolts 31.

If the tank 15 has been plugged into the headpiece 14, the pressure plate 30 butts against the tank 15. The tank 15 can be pushed even further into the headpiece 14 counter to the actuating force of the pressure plate 30. The spring 29, in contrast, provides for a restoring action.

As FIG. 5 shows, a lip seal 32 is seated on the outer lateral surface of the wick guide 21, this lip seal sealing the evaporator chamber 12 in the direction of the tank 15 and closing the interspace between the wick guide 21 and the inner clearance in the extension 26 of the headpiece 14. In this case, the lip seal 32 ensures sealing even in the case of corresponding displacement of the tank 15.

In order for water to be metered into the evaporator 9 from the tank 14, the tank 15 has to be displaced to the right according to FIG. 2, with the result that the tank base 22, with its wick guide 21, penetrates deeper into the evaporator chamber 12, counter to the action of the pressure plate 30. During transport of liquid from the tank to the evaporator, the V-shaped fanned-out portion 24 of the wick 20 reaches the likewise V-shaped surface of the evaporator plate 10. The quantity of liquid that is fed by way of the wick 20, as a result of the capillary action, to the fanned-out portion 24 then evaporates on the evaporator plate 10. Via steam-outlet openings 330 in the burner-tube covering 13, the steam can then be discharged to the hair wound round the shaping element 2. As can be gathered from FIGS. 1, 2 and 4, it is not just possible for the tank 15 to be pushed by way of its end side in order for the desired displacement to be achieved. A connecting component 33 in the form of a half-shell is integrally formed on the tank 15 and extends to the shaping-element end of the hand-held part 1. There, an actuating button 34 with a non-slip surface in the form of transverse ribbing 35 is integrally formed on the connecting component 33. The actuating button 34 is located on that side of the hand-held part 1, which is located opposite the rocker button 4, and also makes it possible for the tank 15 to be actuated by the hand which is gripping the hand-held part 1, i.e. to be displaced in the axial direction, in order for metered liquid to be transported into the evaporator 9. As FIG. 4 shows, the actuating button 34 forms a bead-like elevation at the end of the connecting component 33, which extends around the shaping element 2 essentially parallel to the longitudinal direction of the appliance. The connecting component 33 has a plurality of longitudinal ribs 35 and is designed as a heat guard. As FIG. 3 shows, the connecting component 33 engages around the body of the housing of the appliance in the region of the shaping element 2 to the extent where the connecting component 33 is guided longitudinally. It is possible to provide a dovetail-like longitudinal guide 36 between the connecting component 33 and the housing of the appliance. Longitudinal ribs 37 preferably supported the connecting component 33 over its entire cross section. This achieves advantageous operability of the actuating button 34. Jamming of the connecting component 33 is prevented.

What is claimed is:

1. A hair-shaping apparatus comprising:

a hand-held portion;

a hair-shaping element extending from the hand-held portion;

an evaporator mounted within the shaping element;

a tank mounted within the hair-shaping element in a moveable manner and mounted at an end section of the hair-shaping element located opposite to the hand-held portion;

a dosing device connected to the tank; and an actuating button connected to the tank through a connecting component, the actuating button being positioned on the hand-held portion, wherein moving the actuating button displaces the tank along a longitudinal direction of the apparatus, thereby causing liquid from the tank to be transported to the evaporator via the dosing device.

2. The hair-shaping apparatus of claim 1, wherein the actuating button is positioned on the hand-held portion so as to allow single-handed operation of the apparatus.

3. The hair-shaping apparatus of claim 1, wherein the actuating button is positioned on a side of the apparatus which is located opposite a pivotable clamping device positioned on the shaping element.

4. The hair-shaping apparatus of claim 1, wherein the connecting component has a half-shell form and extends along the shaping element.

5. The hair-shaping apparatus of claim 1, wherein the connecting component forms a heat guard about a portion of the shaping element.

6. The hair-shaping apparatus of claim 1, wherein the connecting component is guided along the longitudinal direction of the apparatus.

7. The hair-shaping apparatus of claim 6, wherein the connecting component is guided along the longitudinal direction by ribs formed on the shaping element.

8. The hair-shaping apparatus of claim 1, wherein the tank and the actuating button are integrally formed.

9. The hair-shaping apparatus of claim 1, wherein the dosing element comprises a wick.

10. The hair-shaping apparatus of claim 9, wherein the wick passes through a tank wall located opposite the evaporator.

11. The hair-shaping apparatus of claim 9, wherein the wick extends eccentrically into the tank.

12. The hair-shaping apparatus of claim 9, wherein an end of the wick includes a shape that compliments a wick contact surface of the evaporator.

13. The hair-shaping apparatus of claim 9, wherein an end of the wick has a V-shape.

14. The hair-shaping apparatus of claim 1, wherein the tank has a wall including a wick guide.

15. The hair-shaping apparatus of claim 14, wherein the wick guide can be inserted into an evaporator chamber wall.

16. The hair-shaping apparatus of claim 15, wherein a radial seal is provided between the wick guide and the evaporator chamber wall.

17. The hair-shaping apparatus of claim 15, wherein a securing spring is provided between the wick guide and the evaporator chamber wall.

18. The hair-shaping apparatus of claim 1, wherein the tank includes a vent valve.

19. The hair-shaping apparatus of claim 18, wherein the vent valve is positioned within a base of the tank.

20. The hair-shaping apparatus of claim 1, wherein the tank has a half-moon cross-sectional shape having a curved portion and a flat portion.

21. The hair-shaping apparatus of claim 20, wherein a cover to the tank is provided on the flat portion.

22. The hair-shaping apparatus of claim 1, wherein the tank is biased in a position in which the dosing device is prevented from contacting the evaporator.

23. A hair-shaping apparatus comprising:

a hand-held portion including an actuating button;

a shaping element extending from the hand-held portion;

an evaporator mounted within the shaping element;

a tank from which the evaporator can be supplied with liquid, the tank being insertable into an end section of the shaping element located opposite to the hand-held portion; and a dosing device for controlling the quantity of liquid passing from the tank to the evaporator, the dosing device being connected to the actuating button when the tank is inserted into the shaping element;

wherein actuation of the actuating button displaces the tank with respect to the evaporator, thereby causing liquid from the tank to be transported to the evaporator via the dosing device.

24. The hair-shaping apparatus of claim 23, wherein the actuating button is positioned on the hand-held portion so as to allow single-handed operation of the apparatus.

25. The hair-shaping apparatus of claim 23, wherein the actuating button is positioned on a side of the apparatus which is located opposite a pivotable clamping device positioned on the shaping element.

26. The hair-shaping apparatus of claim 23, wherein the tank is inserted into a headpiece enclosing the evaporator mounted within the shaping element.

27. The hair-shaping apparatus of claim 23, wherein the dosing element comprises a wick.

28. The hair-shaping apparatus of claim 27, wherein the wick passes through a tank wall located opposite the evaporator.

29. The hair-shaping apparatus of claim 27, wherein the wick extends eccentrically into the tank.

30. The hair-shaping apparatus of claim 27, wherein an end of the wick includes a shape that compliments a wick contact surface of the evaporator.

31. The hair-shaping apparatus of claim 27, wherein an end of the wick has a V-shape.

32. The hair-shaping apparatus of claim 23, wherein the tank has a wall including a wick guide.

33. The hair-shaping apparatus of claim 32, wherein the wick guide can be inserted into an evaporator chamber wall.

34. The hair-shaping apparatus of claim 33, wherein a radial seal is provided between the wick guide and the evaporator chamber wall.

35. The hair-shaping apparatus of claim 33, wherein a securing spring is provided between the wick guide and the evaporator chamber wall.

36. The hair-shaping apparatus of claim 23, wherein the tank includes a vent valve.

37. The hair-shaping apparatus of claim 36, wherein the vent valve is positioned within a base of the tank.

38. The hair-shaping apparatus of claim 23, wherein the tank includes a cover which can be covered by a section of the apparatus when the tank is inserted into the shaping element, the cover of the tank can be opened when the tank has been removed from the apparatus.

39. The hair-shaping apparatus of claim 38, wherein the cover is arranged at an end section of the tank which is directed away from the hand-held portion.

40. The hair-shaping apparatus of claim 38, wherein the cover is arranged beneath a pivotable clamping device positioned on the shaping element.

41. The hair-shaping apparatus of claim 23, wherein the tank has a half-moon cross-sectional shape having a curved portion and a flat portion.

42. The hair-shaping apparatus of claim 41, wherein a cover to the tank is provided on the flat portion.

* * * * *